US007543556B2

(12) United States Patent
Hees et al.

(10) Patent No.: US 7,543,556 B2
(45) Date of Patent: Jun. 9, 2009

(54) CYLINDER CRANKCASE COMPRISING A CYLINDER LINER

(75) Inventors: Eugen Hees, Ebersbach (DE); Helmut Schaefer, Kernen (DE)

(73) Assignee: Daimler AG, Stuttgart (DE)

( * ) Notice: Subject to any disclaimer, the term of this patent is extended or adjusted under 35 U.S.C. 154(b) by 203 days.

(21) Appl. No.: 10/584,016

(22) PCT Filed: Nov. 30, 2004

(86) PCT No.: PCT/EP2004/013573

§ 371 (c)(1),
(2), (4) Date: Jun. 18, 2007

(87) PCT Pub. No.: WO2005/066480

PCT Pub. Date: Jul. 21, 2005

(65) Prior Publication Data

US 2007/0240669 A1 Oct. 18, 2007

(30) Foreign Application Priority Data

Dec. 23, 2003 (DE) ..... 103 60 739

(51) Int. Cl.
*F02F 1/00* (2006.01)

(52) U.S. Cl. ..... 123/193.2

(58) Field of Classification Search ..... 123/193.2, 123/193.3; 29/888.061, 888.06; 92/169.1; 164/98

See application file for complete search history.

(56) References Cited

U.S. PATENT DOCUMENTS

| | | | | | |
|---|---|---|---|---|---|
| 4,562,799 | A * | 1/1986 | Woods et al. | ..... | 123/193.2 |
| 4,794,884 | A | 1/1989 | Hilker et al. | | |
| 5,357,921 | A * | 10/1994 | Katoh et al. | ..... | 123/193.2 |
| 5,445,210 | A | 8/1995 | Brassell | | |
| 5,537,969 | A * | 7/1996 | Hata et al. | ..... | 123/193.2 |
| 5,850,814 | A * | 12/1998 | Fenn et al. | ..... | 123/195 R |
| 6,123,052 | A * | 9/2000 | Jahn | ..... | 123/41.79 |
| 6,363,995 | B1 | 4/2002 | Baranzke | | |
| 6,640,765 | B2 * | 11/2003 | Land et al. | ..... | 123/193.2 |
| 2003/0085018 | A1 | 5/2003 | Engels et al. | | |

FOREIGN PATENT DOCUMENTS

| | | |
|---|---|---|
| DE | 197 55 557 C1 | 2/1999 |
| DE | 198 53 803 C1 | 3/2000 |
| DE | 101 53 305 A1 | 5/2003 |
| DE | 101 53 721 B4 | 5/2003 |

* cited by examiner

*Primary Examiner*—M. McMahon
(74) *Attorney, Agent, or Firm*—Patent Central LLC; Stephan A. Pendorf

(57) ABSTRACT

The invention relates to a cylinder crankcase (4) comprising at least one cylinder liner (2) which is integrally cast in the cylinder crankcase (4). The cylinder liner (2) runs in the cylinder crankcase (4) from a cylinder-head side (6) to an oil-chamber side (8) and has an inner side (10) and an outer side (14). The invention is characterized in that the cylinder liner (2), at least at one end, is longer along the inner side (10) in the axial direction (20) than on the outer side (14). The transition from the inner side (10) to the outer side (14) is affected in the form of encircling, concentric steps (22).

3 Claims, 2 Drawing Sheets

CYLINDER CRANKCASE COMPRISING A CYLINDER LINER

CROSS-REFERENCE TO RELATED APPLICATION

This application is a national stage of PCT/EP2004/013573 filed Nov. 30, 2004 and based upon DE 103 60 739.0 filed on Dec. 23, 2003 under the International Convention.

BACKGROUND OF THE INVENTION

1. Field of the Invention

The invention relates to a cylinder crankcase comprising at least one cylinder liner as described herein.

To meet the high wear conditions which occur in modern engines in the region of the cylinder face, cylinder liners which have a higher wear resistance than the surrounding cast material are used in particular in light alloy engines.

A basic challenge when integrally casting cylinder liners in a cylinder crankcase is to provide a good connection between the cylinder crankcase and the cylinder liner. In this case, a connection which is as firm as possible must already be produced during the integral casting of the cylinder crankcase.

2. Description of Related Art

An improvement in the connection between the cylinder crankcase and the cylinder liner can be achieved, for example, by a surface treatment of the cylinder liner; DE 101 53 305 A1 may be mentioned here by way of example. On the other hand, by the geometrical configuration of the casting tool, the melt flow can be controlled in such a way that as high a flow velocity as possible is achieved along the outer side of the cylinder liner and, as a result, a disturbing oxide skin on the surface of the cylinder liner is broken up. An example of this measure is given in DE 101 53 721 A1. Disclosed in DE 198 53 803 C1 is a cylinder liner which has a bevel on an oil-chamber side of the cylinder crankcase.

SUMMARY OF THE INVENTION

The object of the invention is to provide an improved connection between the cylinder liner and the cylinder crankcase.

The solution of the object consists in a cylinder crankcase comprising at least one cylinder liner having the features as described herein.

The cylinder crankcase as described has at least one cylinder liner. The following arrangement of the cylinder liners is therefore suitable for all internal combustion engines having any desired number of cylinder liners. The cylinder liner is integrally cast in the cylinder crankcase, the cylinder liner running in the cylinder crankcase from a cylinder-head side to an oil-chamber side. The cylinder liner has an inner side, which forms a "cylinder tube", and an outer side, around which the cylinder crankcase is cast directly.

The cylinder crankcase as described is characterized in that the cylinder liner, at least at one end, i.e. either on the oil-chamber side or on the cylinder-head side, is longer on the inner side, as viewed in axial direction, than on the outer side. In this case, the transition from the inner side to the outer side is configured in the form of encircling, concentric steps.

During the pouring of the casting metal into a mold cavity for forming the cylinder crankcase, the melt impinges on the cylinder liner already fixed in the mold cavity, the melt flow being directed in such a way that it is at first aimed at an end of the cylinder liner. Due to the steps which are provided on this end of the cylinder liner, the melt is swirled, as a result of which the oxide skin which is present on the surface of the cylinder liner is broken up in this region and better fusing of the casting metal on the cylinder liner is achieved.

Compared with a cylinder liner which is designed at right angles on its underside, the stepped cylinder liner according to the invention has the advantage that settling of the cylinder liner in the direction of an oil chamber of the cylinder crankcase is prevented. This is due to the fact that the region which is left free by the stepped cylinder liner is filled by the casting metal and is therefore firmly joined together with the actual body of the cylinder crankcase. Slipping of the cylinder liner is prevented by this surrounding cast material. Due to the stepped configuration of the cylinder liner, settling of the cylinder liner is prevented to a greater extent than if the bush were to be designed with a conventional straight bevel.

Compared with a straight bevel, the stepped shape of the liner end also has the advantage that a fusing surface which is available to the melt for connecting to the cylinder liner is enlarged. For example, the enlargement of the fusing surface compared with a 45° bevel is a factor of root two in the case of a right-angled stepped shape, accordingly an enlargement of around 40%.

In a preferred embodiment of the invention, the steps are provided on the cylinder liner on an oil-chamber side, since the casting-on of the melt and thus the melt flow are effected from an oil-chamber side in the case of most cylinder crankcases. In principle, however, it may also be expedient, with another casting-on technique, to design the cylinder-head side of the cylinder liner in a stepped manner. In this case, with regard to the casting-on of the melt, the same advantageous effect, namely the better casting-on at a higher casting-on surface, is achieved.

From the point of view of both the production technique and the functioning of the steps in the integrally cast state, it has been found that an advantageous number of steps per end is between two and six.

In particular if the cylinder liner is cut off from a tube, it is expedient for this purpose to use a stepped parting tool. In this case, the steps are already incorporated solely by the parting of the cylinder liner from the tube, which can prevent an additional processing step.

Advantageous embodiments of the invention are explained in more detail with reference to the following figures.

BRIEF DESCRIPTION OF THE DRAWINGS

Figure 1:
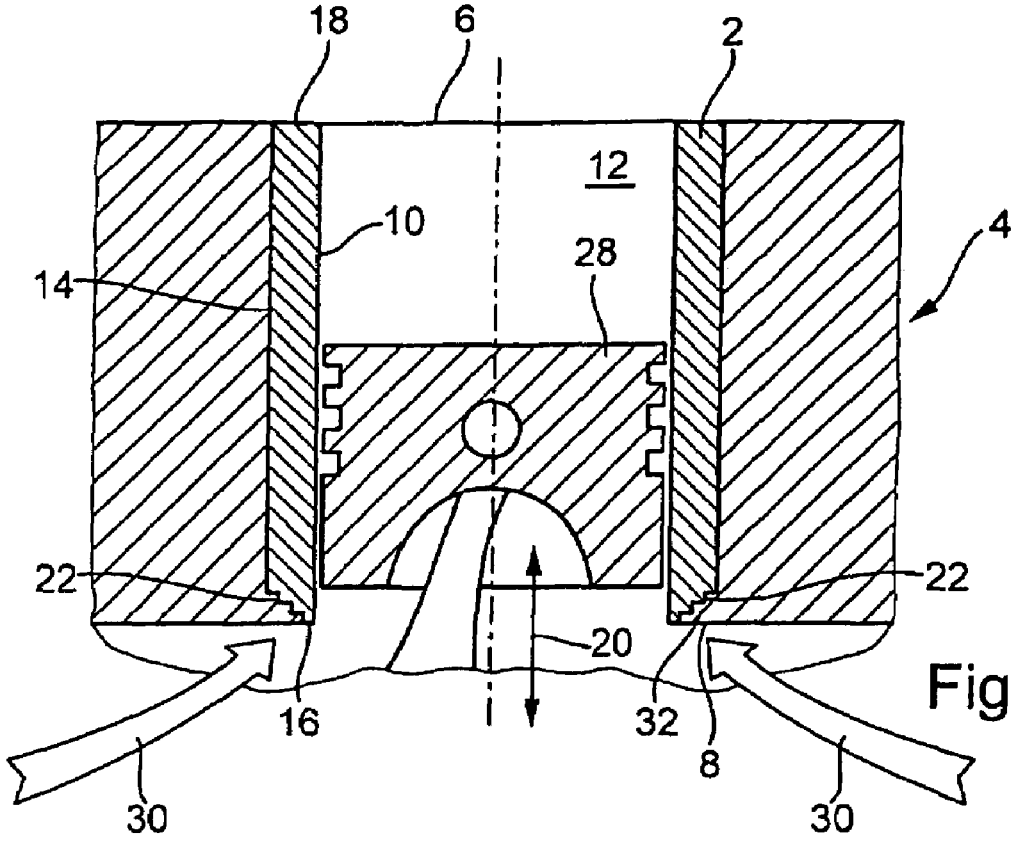

Description of the figures:

FIG. 1: shows a schematic cross-sectional illustration through a cylinder crankcase comprising a cylinder liner.

Figure 2:
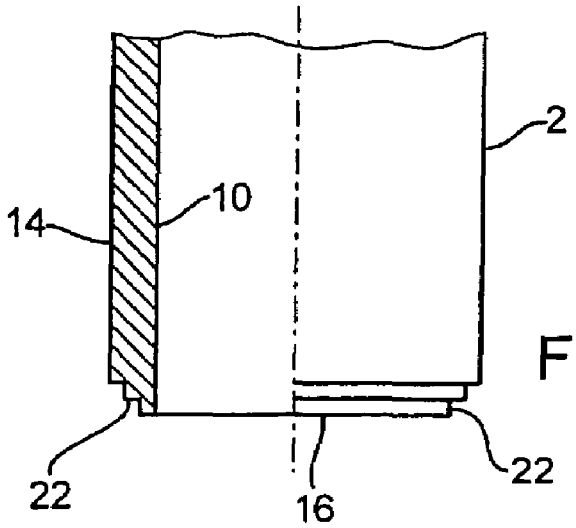

FIG. 2: shows an illustration of a stepped cylinder liner.

Figure 3A:
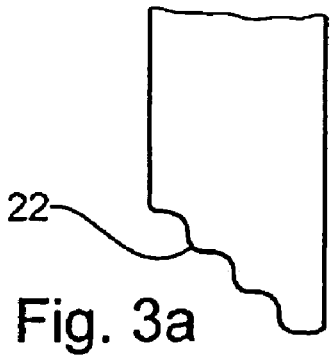
Figure 3B:
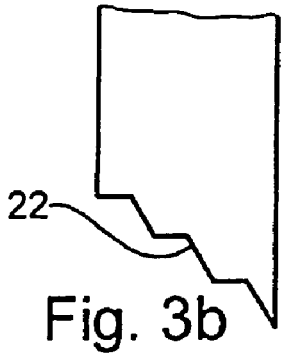
Figure 3C:
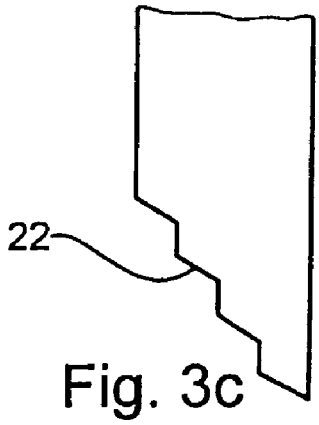

FIGS. 3*a* to *c:* show three variants of the stepped shape, differing from the rectangular stepped shape.

Figure 4:
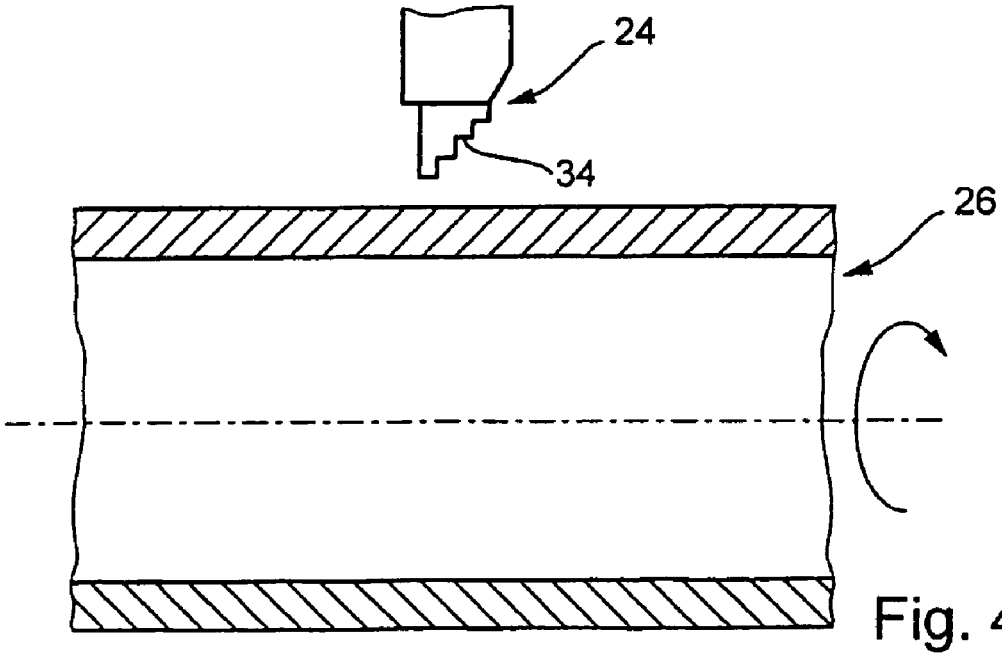

FIG. 4: shows the cutting-off of a cylinder liner from a tube using a stepped turning tool.

DETAILED DESCRIPTION OF THE INVENTION

Shown in FIG. 1 is a schematic, simplified illustration of a cylinder crankcase having a cylinder tube 12 which is formed by a cylinder liner 2 integrally cast in the cylinder crankcase 4. The cylinder liner 2 has an end 18 which is located on a cylinder-head side 6 of the cylinder crankcase 4 and an end 16 which is located on an oil-chamber side 8 of the cylinder crankcase 4 (oil-chamber-side end 16).

The cylinder liner 2 has an inner side 10, which surrounds the cylinder tube 12, a piston 28 being arranged in an axially movable manner in the cylinder tube 12. Furthermore, the cylinder liner 2 has an outer side 14, on which the cylinder crankcase 4 is cast by being cast around said outer side 14.

At the oil-chamber-side end 16, the cylinder liner 2 is designed in such a way that it is longer at its inner side 10 in the axial direction 20 than at the outer side 14. The transition is effected by, in this case four rectangular, radially encircling steps 22.

The arrows 30 schematically illustrate the course of the melt flow during the casting of the cylinder crankcase 4. This melt flow impinges on the steps 22 of the cylinder liner 2. Due to the impingement of the liquid metal, in this example an aluminum alloy, said metal is swirled, in the course of which an oxide skin adhering to the surface of the cylinder liner is broken up. During the solidification of the casting metal, a firm connection is obtained between the cylinder liner 2 and the cylinder crankcase 4, this connection being produced by alloying.

Furthermore, the projections 32 which form part of the cylinder crankcase 4 prevent the cylinder liner 2 from being moved under the action of force in the direction of the oil-chamber side 8. This prevents "settling" of the cylinder liner 2.

FIG. 2 shows a partial section through a cylinder liner 2 which likewise has right-angled steps.

FIGS. 3*a* to *c* show stepped shapes which differ from the right-angled cross section. In principle, it may be expedient for the step edges to be rounded off, as shown in FIG. 3*a*. Likewise, it may be expedient, in particular with due regard to the production technique, for the steps to differ from the right-angled configuration in both the vertical and horizontal directions (FIGS. 3*b*, 3*c*).

Schematically shown in FIG. 4 is a tube 26, from which a cylinder liner is cut off. Used for this purpose is a parting tool 24 which has a stepped contour 34 which incorporates the stepped configuration 22 when the cylinder liner 2 (not shown here) is being turned off. The stepped turning tool 24 has the advantage that the stepped configuration 22 is incorporated directly during the turning-off of the cylinder liner. A possible additional method step which would possibly be necessary due to the subsequent incorporation of the steps is thus avoided.

Now that the invention has been described, we claim:

1. A cylinder crankcase comprising at least one cylinder liner (2) which is integrally cast in the cylinder crankcase (4) and runs in the cylinder crankcase (4) from a cylinder-head side (6) to an oil-chamber side (8), the cylinder liner (2) having an inner side (10), which forms a cylinder tube (12), and an outer side (14), around which the cylinder crankcase (4) is cast completely and directly, characterized in that the at least one cylinder liner (2), at least at one end (16, 18), is longer on the inner side (10) in the axial direction than on the outer side (14), and in that the transition from the inner side (10) to the outer side (14) is effected in the form of encircling, concentric steps (22).

2. The cylinder crankcase as claimed in claim 1, characterized in that the at least one end (16, 18), having steps (22), of the cylinder liner (2) is an oil-chamber-side end (16).

3. The cylinder crankcase as claimed in claim 1 or 2, characterized in that the number of steps (22) per end (16, 18) is between 2 and 6.

* * * * *